United States Patent [19]

Palka

[11] 4,412,708

[45] Nov. 1, 1983

[54] CABINET DOOR HINGE CONSTRUCTION

[75] Inventor: James J. Palka, Arlington Heights, Ill.

[73] Assignee: Pace Industries Inc., Chicago, Ill.

[21] Appl. No.: 303,898

[22] Filed: Sep. 21, 1981

[51] Int. Cl.[3] ..... E05D 5/10; E05D 7/08

[52] U.S. Cl. ..... 312/138 R; 312/224; 312/227; 16/378

[58] Field of Search ..... 312/138 R, 138 A, 292, 312/214, 224, 226, 227; 16/378, 379, 273

[56] References Cited

U.S. PATENT DOCUMENTS

| | | | |
|---|---|---|---|
| 2,166,430 | 7/1939 | Green | 312/227 |
| 3,109,685 | 11/1963 | Skorupa | 312/227 |
| 3,244,464 | 4/1966 | McMurtrie et al. . | |
| 3,441,329 | 4/1969 | Solomon . | |
| 3,451,706 | 6/1969 | Baermann | 292/251.5 |
| 3,555,733 | 1/1971 | Horgan, Jr. | 16/378 |
| 3,628,845 | 12/1971 | Grimm | 312/138 R |
| 3,855,667 | 12/1974 | Messina | 16/378 |
| 3,909,091 | 9/1975 | Tantillo . | |
| 4,134,625 | 1/1979 | Palka | 312/224 |
| 4,363,528 | 12/1982 | Olashaw et al. | 312/292 |

FOREIGN PATENT DOCUMENTS

| | | | |
|---|---|---|---|
| 102723 | 9/1965 | Denmark | 16/378 |
| 1118516 | 11/1961 | Fed. Rep. of Germany | 16/378 |
| 1554195 | 11/1969 | Fed. Rep. of Germany | 312/224 |

OTHER PUBLICATIONS

Catalog of Bertch Wood Specialties, Omega Cabinets, Date 7/1982, 4 pages.

*Primary Examiner*—Victor N. Sakran
*Attorney, Agent, or Firm*—Wm. A. Snow

[57] ABSTRACT

A hinge construction for a cabinet door having nylon dowel rods partially positioned in the upper and lower ends of the door adjacent one end thereof and projecting outwardly thereof for positioning in aligned bores adjacent the edge of the cabinet upper and lower walls, with a thick nylon washer on the lower dowel.

2 Claims, 6 Drawing Figures

CABINET DOOR HINGE CONSTRUCTION

SUMMARY OF THE INVENTION

A hinge for oak bathroom cabinet doors having a nylon dowel rod partially positioned in a bore and extending above the upper end of the door adjacent one side of a door, a second nylon dowel rod partially positioned in a bore in the lower end of said door aligned with the aforesaid bore and extending downwardly of the door and having a thickened nylon washer on said second dowel rod, and opposed bores in the cabinet door frame aligned with the bores in the cabinet doors to seat the free ends of the dowel rods.

DETAILED DESCRIPTION OF THE DRAWINGS

Figure 1:
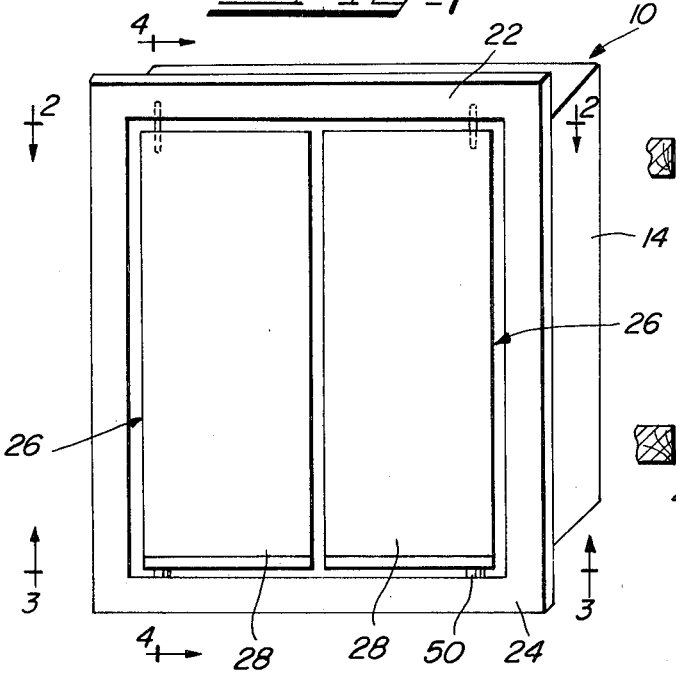
FIG. 1 is a front plan view of a bathroom cabinet incorporating the present invention.
Figure 2:
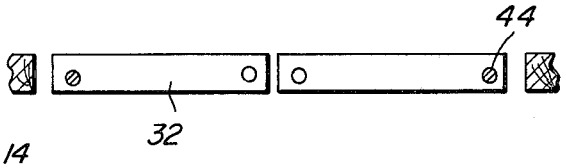
FIG. 2 is a cross-sectional view taken on the lines 2—2 of FIG. 1.
Figure 3:
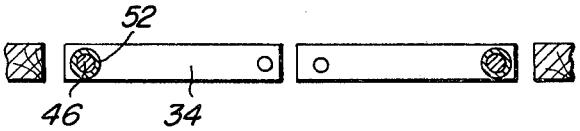
FIG. 3 is a cross-sectional view taken on the lines 3—3 of FIG. 1.
Figure 4:
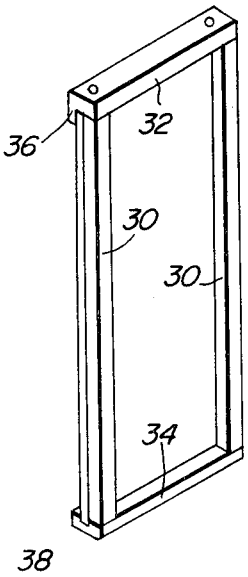
FIG. 4 is a perspective view of the door for the cabinet.

The bathroom cabinet 10 comprises the usual side walls 12, top wall 14, bottom wall 16, rear wall 17, and side, top and bottom frames 18, 20, 22, 24 secured to the front face of the walls 12, 14 and 16 respectively. (See FIGS. 1 and 5.)

In the embodiment shown in the drawings, the door 26 of the bathroom cabinet contains a mirror 28 held in position by the side rails 30 and the L-shaped top rail 32 and bottom rail 34 with the front portions 36, 38 overlapping the top and bottom of the mirror 28.

The L-shaped rails 32, 34 forming top and bottom walls of the door are bored as at 40, 42, respectively, medially of the side edges thereof to receive nylon dowel rods 44, 46, respectively, and are frictionally held therein but with a portion of the dowels extending above and below the rails 32, 34. The dowel 40 is longer than the dowel 42.

Through bores 48, 50 are drilled in the top and bottom walls 14, 16, respectively, in alignment with each other and in alignment with the bores 40, 42.

The dowel rod 46 is provided with a thick nylon washer 52.

Figure 5:
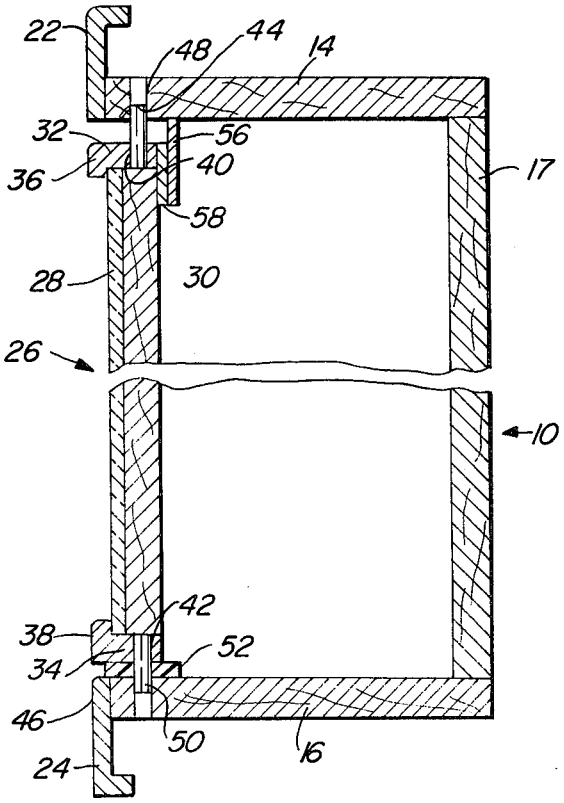
FIG. 5 is a fragmentary, enlarged, cross-sectional view taken on the lines 4—4 of FIG. 1.
Figure 6:
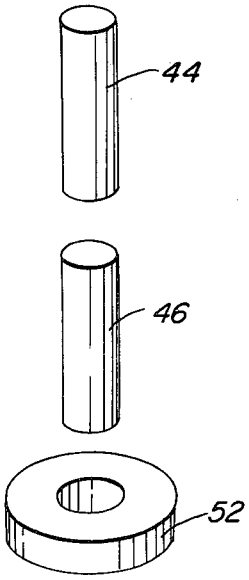
FIG. 6 is a perspective view of the dowel rods and washer.

It is to be noted from FIG. 5 that the height of the door 26 is less than the area between the top and bottom walls 14, 16.

To assemble the door in position, the door is tilted with the bottom rail 34 away from the top wall, the dowel rod 44 is inserted in the bore 48 and the door shifted upwardly. The bottom rail is moved inwardly into the area between the top and bottom walls 22, 24, with the washer 52 thereon, whereby the dowel rod 46 will slip into the bore 50. The entire door will rest on the washer 52 which is positioned on the dowel rod 46. The door is now swingable about the dowels.

To retain the doors in closed position, a magnet 56 is hung from the top wall 14 and a piece of iron metal 58 is secured to the back of the door in alignment therewith.

Appropriate hand grips 60 are positioned on the door 26.

Although but one specific embodiment of this invention is herein shown and described, it will be understood that details of the construction shown may be altered or omitted without departing from the spirit of the invention as defined by the following claims.

I claim:

1. A door hinge construction for cabinets having an open front, said cabinet and door each having top and bottom walls, said door having a lengthwise dimension less than the area between the top and bottom walls of the cabinet, nylon dowels rods partially mounted in said door in alignment with each other adjacent one side thereof and on the top and bottom walls of said door, and having portions of said dowel extending beyond said top and bottom walls, aligned bores in said cabinet, top and bottom walls aligned with said dowel rods, and a thick washer on said lower dowel rod whereby when the door is tilted away from the cabinet walls, the upper dowel rod is inserted in the bore of the top wall and by raising the door in the aforesaid area, the lower dowel rod with the washer is placed in the bore in the bottom wall.

2. The device according to claim 1 wherein said door is provided with a frame having top and bottom L-shaped rails, a mirror positioned on said door frame rails and held thereon by said L-shaped rails, bores at one end of said top and bottom L-shaped rails, and a portion of said dowel rods frictionally held in said bores.

* * * * *